US011021679B2

(12) United States Patent
Shen et al.

(10) Patent No.: US 11,021,679 B2
(45) Date of Patent: Jun. 1, 2021

(54) PACKAGED COMPOSITION

(71) Applicant: The Procter & Gamble Company, Cincinnati, OH (US)

(72) Inventors: Rui Shen, Beijing (CN); Pu Zhao, Beijing (CN); Zhe Guan, Beijing (CN); Ruizhi Pei, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 37 days.

(21) Appl. No.: 16/506,089

(22) Filed: Jul. 9, 2019

(65) Prior Publication Data

US 2020/0010781 A1 Jan. 9, 2020

(51) Int. Cl.

| | |
|---|---|
| ***C11D 17/00*** | (2006.01) |
| ***C11D 3/04*** | (2006.01) |
| ***C11D 3/50*** | (2006.01) |
| ***C11D 17/04*** | (2006.01) |
| ***C11D 11/00*** | (2006.01) |
| ***C11D 3/37*** | (2006.01) |

(52) U.S. Cl.

CPC ..... *C11D 3/046* (2013.01); *C11D 3/3707* (2013.01); *C11D 3/505* (2013.01); *C11D 11/0017* (2013.01); *C11D 17/044* (2013.01)

(58) Field of Classification Search

CPC ... C11D 17/0039; C11D 3/3707; C11D 3/505; C11D 11/0082

See application file for complete search history.

(56) References Cited

U.S. PATENT DOCUMENTS

| | | | | |
|---|---|---|---|---|
| 4,209,417 | A | 6/1980 | Whyte | |
| 7,056,877 | B2 | 6/2006 | Caswell et al. | |
| 7,867,968 | B1 | 1/2011 | Aouad | |
| 9,347,022 | B1 * | 5/2016 | Frentzel | C11D 3/50 |
| 10,301,575 | B2 | 5/2019 | Lynch | |
| 10,538,720 | B2 | 1/2020 | Vasquez Valdivieso | |
| 2005/0020476 | A1 | 1/2005 | Wahl | |
| 2010/0298191 | A1 | 11/2010 | Denome | |
| 2011/0082066 | A1 | 4/2011 | Wrubbel | |
| 2011/0097369 | A1 | 4/2011 | Sunder | |
| 2018/0100124 | A1 | 4/2018 | Piorkowski | |
| 2019/0218480 | A1 * | 7/2019 | Holderbaum | C11D 3/507 |
| 2020/0087598 | A1 * | 3/2020 | Struillou | B01J 13/206 |

FOREIGN PATENT DOCUMENTS

| | | | |
|---|---|---|---|
| CN | 103205328 | B | 6/2014 |
| WO | 02090481 | A1 | 11/2002 |
| WO | 2017125235 | A1 | 7/2017 |
| WO | 2018055107 | A1 | 3/2018 |
| WO | 2018055116 | A1 | 3/2018 |
| WO | 2018055119 | A1 | 3/2018 |
| WO | 2018055121 | A1 | 3/2018 |

OTHER PUBLICATIONS

International Search Report for International Application No. PCT/CN2018/094991, dated Apr. 15, 2019, 9 pages.

* cited by examiner

*Primary Examiner* — John R Hardee

(74) *Attorney, Agent, or Firm* — Gary J. Foose

(57) ABSTRACT

Perfume-containing particles are provided for delighting the consumers with an enhanced olfactory experience during and after the laundering process. Each of such particles contains perfume, polyethylene glycol, and water-soluble or water-dispersible filler particles, while the water-soluble or water-dispersible filler particles are characterized by a particle size of from 5 microns to 150 microns.

17 Claims, No Drawings

PACKAGED COMPOSITION

FIELD OF THE INVENTION

This invention is related to packaged composition comprising a plurality of perfume-containing particles.

BACKGROUND OF THE INVENTION

Scent is recognized to be a source of pleasure to consumers when they do their laundry. Consumers may associate certain scents with performance of the laundry products and as an indicator of quality of the laundry products. Laundry products that provide a pleasant or enhanced scent experience to the consumer when she dispenses the laundry product, transfers a load of wet laundry from the washer to the dryer or to a drying rack or line, or when she wears the clothing meet this consumer need.

Correspondingly, perfumed particles are becoming increasingly popular as a laundry scent additive, and there are a variety of packaged compositions containing perfume-containing particles for treating laundry. The perfumed particles can be used to impart new scent to, or enhance existing scent in, the articles being washed.

Most of such perfumed particles contains one or more perfume ingredients mixed with one or more carrier materials. The perfume ingredients may be selected from the group consisting of free perfumes, encapsulated perfumes, and combinations thereof. Some perfumed particles may contain perfume microcapsules that encapsulate perfumes within a capsule wall. The perfume microcapsules can become entrapped or deposited on the articles being washed. When the consumer wears or uses the articles so washed, the perfume microcapsules can rupture and release a pleasant amount of perfume that provides pleasure to the consumer. The carrier materials may be selected from the group consisting of: polymers (e.g., polyethylene glycol, ethylene oxide/propylene oxide block copolymers, polyvinyl alcohol, polyvinyl acetate, and derivatives thereof), proteins (e.g., gelatin, albumin, casein, and the like), sugars (e.g., dextrose, fructose, galactose, glucose, isoglucose, sucrose, and the like), polysaccharides (e.g., starch, cellulose, or derivatives thereof), water-soluble or water-dispersible fillers (e.g., sodium chloride, sodium sulfate, sodium carbonate/bicarbonate, zeolite, silica, clay, and the like), and combinations thereof. Some perfumed particles contain only one type of carrier material, while others may contain a mixture of two or more different carrier materials.

A particularly preferred type of perfumed particles contains a mixture of a polymer (such as polyethylene glycol or polyvinyl acetate) with a water-soluble or water-dispersible filler (such as sodium chloride, sodium carbonate, sodium bicarbonate, zeolite, silica, and the like). Such perfumed particles are typically made by first forming a viscous slurry containing the molten polymer mixed with the perfume ingredients and particles of the water-soluble or water-dispersible filler, followed by shaping the viscous slurry into solid particles of a desired shape upon cooling and/or drying. However, significant compositional variations have been observed in perfume-containing particles formed by this process, which may result in poor product quality control, inconsistent user experience, and consumer dissatisfaction.

There is therefore a need to provide perfumed particles with reduced compositional variations. There is a further desire to meet the above-mentioned need with little or no increase in capital investment, operating cost, and/or processing complexity.

SUMMARY OF THE INVENTION

Without being bound by any theory, it is believed that uneven distribution and sedimentation of the water-soluble or water-dispersible filler particles in the molten polymer during the particle-making process may have caused or at least exacerbated the compositional variations observed in the perfumed particles so formed. Therefore, inventors of the present invention employ water-soluble or water-dispersible filler particles characterized by a specific particle size distribution, which help to significantly reduce compositional variations in the resulting perfumed particles.

In one aspect, the present invention is related to a packaged composition comprising a plurality of perfume-containing particles, while each of the perfume-containing particles comprises:

a perfume ingredient;

polyethylene glycol; and water-soluble or water-dispersible filler particles, wherein from about 80 wt % to about 100 wt % of said water-soluble filler particles are characterized by a particle size ranging from about 5 microns to about 150 microns, preferably from about 10 microns to about 125 microns, more preferably from about 10 microns to about 105 microns, most preferably from about 10 microns to about 90 microns, while each of such perfume-containing particles has a mass of from about 0.1 mg to about 5 g and a maximum dimension of from about 3 mm to about 10 mm.

The water-soluble or water-dispersible filler particles preferably comprise a filler material selected from the group consisting of sodium chloride, sodium sulfate, sodium carbonate, sodium bicarbonate, potassium chloride, potassium sulfate, potassium carbonate, potassium bicarbonate, magnesium chloride, magnesium sulfate, calcium bicarbonate, zeolite, silica, clay, and combinations thereof; wherein said water-soluble or water-dispersible filler particles preferably comprises sodium chloride, sodium sulfate, sodium carbonate, and combinations thereof. Such water-soluble or water-dispersible filler particles may be present in each perfume-containing particle in an amount ranging from about 5% to about 90%, preferably from about 10% to about 70%, more preferably from about 20% to about 60%, by total weight of each perfume-containing particle.

Each of the above-mentioned perfume-containing particles may comprise one or more perfume ingredients selected from the group consisting of free perfumes, encapsulated perfumes, and combinations thereof. In a specific embodiment, the perfume-containing particles contain one or more free perfumes, which are preferably present in an amount ranging from about 0.1% to about 20%, preferably from about 0.5% to about 15%, more preferably from about 1% to about 10%, by total weight of each perfume-containing particle. Further, the perfume-containing particles may contain, either alone or in combination with the free perfumes, an encapsulated perfume. Preferably, the encapsulated perfume is present in friable perfume microcapsules, while the friable perfume microcapsules are preferably present in an amount ranging from about 0.1% to about 20%, preferably from about 0.5% to about 10%, more preferably from about 1% to about 5%, by total weight of each perfume-containing particle.

The polyethylene glycol used in the present invention may have a weight average molecular weight (Mw) ranging from about 2,000 to about 30,000 Daltons, preferably from about 3,000 to about 20,000 Daltons, more preferably from about 4,000 to about 15,000 Daltons. Such polyethylene glycol may be present in each perfume-containing particle in an amount ranging from about 5% to about 90%, preferably from about 10% to about 70%, more preferably from about 20% to about 60%, by total weight of each perfume-containing particle.

Each of the above-mentioned perfume-containing particles may have a hemispherical shape or a compressed hemispherical shape.

In another aspect, the present invention is related to a process for treating laundry, comprising the step of dosing to a laundry washing machine or a laundry wash basin from about 13 g to about 27 g of the above-described packaged composition.

In yet another aspect, the present invention relates to a method of making perfume containing particles, comprising the steps of:

a. Forming a viscous slurry by mixing a perfume ingredient, molten polyethylene glycol, water-soluble or water-dispersible filler particles, and optionally one or more other ingredients, while the water-soluble or water-dispersible filler particles can pass through a sieve characterized by a mesh size of about 150 μm; and
b. forming perfume-containing particles from the viscous slurry, while each of the perfume-containing particles so formed has a mass of from about 0.1 mg to about 5 g and a maximum dimension of from about 3 mm to about 10 mm.

Preferably, the water-soluble or water-dispersible filler particles used in Step (a) hereinabove can pass through a second sieve characterized by a mesh size of about 125 μm. More preferably, the water-soluble or water-dispersible filler particles can pass through a third sieve characterized by a mesh size of about 106 μm.

In addition, it is desirable that the water-soluble or water-dispersible filler particles used in Step (a) hereinabove cannot pass through a fourth sieve characterized by a mesh size of about 5 μm. It is more desirable that such water-soluble or water-dispersible filler particles cannot pass through a fifth sieve characterized by a mesh size of about 10 μm.

These and other aspects of the present invention will become more apparent upon reading the following detailed description of the invention.

DETAILED DESCRIPTION OF THE INVENTION

Features and benefits of the various embodiments of the present invention will become apparent from the following description, which includes examples of specific embodiments intended to give a broad representation of the invention. Various modifications will be apparent to those skilled in the art from this description and from practice of the invention. The scope of the present invention is not intended to be limited to the particular forms disclosed and the invention covers all modifications, equivalents, and alternatives falling within the spirit and scope of the invention as defined by the claims.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

As used herein, terms such as "a" and "an" when used in a claim, are understood to mean one or more of what is claimed or described. The terms "comprise," "comprises," "comprising," "contain," "contains," "containing," "include," "includes" and "including" are all meant to be non-limiting.

The term "perfume-containing particle" refers to a particle comprising one or more perfume ingredients, such as free perfumes, pro-perfumes, encapsulated perfumes (including perfume microcapsules), and the like. Preferably, such perfume-containing particles contain perfumes encapsulated in perfume microcapsules, especially friable perfume microcapsules.

The term "aspect ratio" refers to the ratio of the longest dimension of the perfume-containing particles over its shortest dimension. For example, when such perfume-containing particles have a hemispherical or compressed hemispherical shape, the aspect ratio is the ratio between the based diameter of the perfume-containing particles over its height.

The term "consisting essentially of" means that the composition contains less than about 1%, preferably less than about 0.5%, of ingredients other than those listed.

Further, the term "substantially free of" or "substantially free from" means that the indicated material is present in the amount of from 0 wt % to about 1 wt %, preferably from 0 wt % to about 0.5 wt %, more preferably from 0 wt % to about 0.2 wt %. The term "essentially free of" means that the indicated material is present in the amount of from 0 wt % to about 0.1 wt %, preferably from 0 wt % to about 0.01 wt %, more preferably it is not present at analytically detectable levels.

As used herein, all concentrations and ratios are on a weight basis unless otherwise specified. All temperatures herein are in degrees Celsius (° C.) unless otherwise indicated. All conditions herein are at 20° C. and under the atmospheric pressure, unless otherwise specifically stated. All polymer molecular weights are determined by weight average number molecular weight unless otherwise specifically noted.

Perfume-Containing Particles

The perfume-containing particles of the present invention may each have a longest dimension of from about 3 mm to 10 mm, preferably from about 4 mm to about 9 mm, more preferably from about 5 mm to about 8 mm Preferably, each of such perfume-containing particles may have an aspect ratio of no more than about 5, e.g., from about 1 to about 5, preferably from about 1.5 to about 4, more preferably from about 2 to about 4.

The perfume-containing particles of the present invention may have any shape selected from the group consisting of spherical, hemispherical, compressed hemispherical, cylindrical, disc, circular, lentil-shaped, oblong, cubical, rectangular, star-shaped, flower-shaped, and any combinations thereof. Lentil-shaped refers to the shape of a lentil bean. Compressed hemispherical refers to a shape corresponding to a hemisphere that is at least partially flattened such that the curvature of the curved surface is less, on average, than the curvature of a hemisphere having the same radius. A compressed hemispherical particle can have an aspect ratio (i.e., the ratio of its base diameter over its height that is orthogonal to the base) of from about 2.0 to about 5, alternatively from about 2.1 to about 4.5, alternatively from about 2.2 to about 4. Oblong-shaped particle refers to a particle having a maximum dimension and a secondary dimension orthogonal to the maximum dimension, wherein the ratio of maximum dimension to the secondary dimension is greater than about 1.2, preferably greater than about 1.5, more preferably greater than about 2.

Preferably, the perfume-containing particles of the present invention have a hemispherical or compressed hemispherical shape.

An individual perfume-containing particle may have a volume from about 0.003 $cm^3$ to about 0.15 $cm^3$. Further, individual perfume-containing particles of the present invention can each have a mass of from about 0.1 mg to about 5 g, preferably from about 1 mg to about 1 g, more preferably from about 5 mg to about 500 mg, still more preferably from about 10 mg to about 250 mg, still more preferably from about 15 mg to about 125 mg, with alternative combinations thereof and any whole numbers or ranges of whole numbers of mg within any of the aforementioned ranges.

In a preferred but not necessary embodiment of the present invention, perfume-containing particles of the present invention have a density lower than water, so that they can float on water. For example, such perfume-containing particles may have a density ranging from about 0.5 $g/cm^3$ to about 0.98 $g/cm^3$, preferably from about 0.7 $g/cm^3$ to about 0.95 $g/cm^3$, more preferably from about 0.8 $g/cm^3$ to about 0.9 $g/cm^3$.

A plurality of perfume-containing particles of the present invention can have different shapes, sizes, mass, and/or density.

Each of such perfume-containing particles may comprise: a perfume ingredient; polyethylene glycol; water-soluble or water-dispersible filler particles characterized by a specific particle size distribution; and optionally one or more adjunct ingredients, as described in detail hereinafter.

Perfume Ingredients

The perfume-containing particles of the present invention may comprise from about 0.1 wt % to about 20 wt %, preferably from about 0.5 wt % to about 15 wt %, more preferably from about 1 wt % to about 10 wt % of one or more perfume ingredients, such as free perfumes, pro-perfumes, encapsulated perfumes (including perfume microcapsules), and the like.

In one embodiment, the perfume-containing particles comprise free perfumes and are substantially or essentially free of encapsulated perfumes. In such an embodiment, each perfume-containing particle may comprise no more than about 25%, preferably no more than about 20% (e.g., from about 0.1% to about 20%), more preferably from about 0.5% to about 15%, most preferably from about 1% to about 10%; alternatively, from about 9% to about 20%; alternatively, from about 10% to about 18%; alternatively, from about 11% to about 13%, alternatively, combinations thereof, of free perfumes by weight of such particle.

In another embodiment, the perfume-containing particles each comprise encapsulated perfumes (i.e., perfumes carried by a carrier material such as starch, cyclodextrin, silica, zeolites or clay or in form of perfume microcapsules), but are substantially or essentially free of free perfumes. Preferably, the perfume-containing particles comprise perfume oil encapsulated in perfume microcapsules (PMCs), which are preferably friable (verses, for example, moisture activated PMCs) but can also be moisture activated. For purposes of the present invention, the term "perfume microcapsules" or "PMC" describes both perfume microcapsules and perfume nanocapsules. In such an embodiment, each perfume-containing particle may each comprise from about 0.1% to 20%, preferably from about 0.5% to about 10%, more preferably from about 1% to about 5%, alternatively from about 4% to about 7%, alternatively from about 5% to about 7%, alternatively combinations thereof, of perfume microcapsules (preferably friable perfume microcapsules) by weight of the particles.

In yet another embodiment, each of the perfume-containing particles comprises both free perfumes and encapsulated perfumes (preferably in form of perfume microcapsules, and more preferably in form of friable perfume microcapsules), e.g., at a weight ratio ranging from about 1:5 to about 5:1, alternatively from about 1:4 to about 4:1, further alternatively from about 1:3 to about 3:1. In another embodiment, the perfume-containing particles may comprise from about 1% to about 10%, alternatively from about 2% to about 12%, alternatively from about 2% to about 8%, alternatively from about 3% to about 8%, alternatively from about 4% to about 7%, alternatively from about 5% to about 7%, alternatively combinations thereof, of PMCs by weight of the particles. In this embodiment, the perfume encapsulated by the PMC may comprise from about 0.6% to about 4% of perfume by weight of the particles.

In one embodiment, the PMCs comprise melamine/formaldehyde shells, which are commercially available from Appleton, Quest International, International Flavor & Fragrances, or other suitable sources. In a preferred embodiment, the shells of the PMCs are coated with polymer to enhance the ability of the PMCs to adhere to fabric.

In yet still another embodiment, the perfume-containing particles may comprise a formaldehyde scavenger. In yet still another embodiment, the scent of the perfume-containing particles is coordinated with scent(s) of other fabric care products (e.g., laundry detergent, fabric softener). This way, consumers who like APRIL FRESH scent, may use a packaged composition containing a plurality of perfume-containing particles having an APRIL FRESH scent, thereby coordinating the scent experience of washing their laundry with their scent experience from using APRIL FRESH. The perfume-containing particles of the present invention may be sold as a product array (with laundry detergent and/or fabric softener) having coordinated scents.

Polyethylene Glycol

The perfume-containing particles of the present invention further comprise a water-soluble polymer, e.g., polyethylene glycol (PEG). PEG has a relatively low cost, may be formed into many different shapes and sizes, minimizes free perfume diffusion, and dissolves well in water. The term "polyethylene glycol" or "PEG" as used herein includes homopolymers containing repeating units of ethylene oxide, random copolymers containing repeating units of ethylene oxide and propylene oxide, block copolymers containing blocks of polyethylene oxide and polypropylene oxide, and combinations thereof.

Preferably, each of the perfume-containing particles comprises from about 5 wt % to about 90 wt %, preferably from about 10 wt % to about 70 wt %, more preferably from about 20 wt % to about 60 wt % of PEG, and more preferably such PEG is characterized by a weight average molecular weight (Mw) ranging from about 2,000 to about 30,000 Daltons, preferably from about 3,000 to about 20,000 Daltons, more preferably from about 4,000 to about 15,000 Daltons.

Suitable PEGs include homopolymers commercially available from BASF under the tradenames of Pluriol® E 8000.

A particularly preferred PEG within the meaning of the present invention is an ethylene oxide-propylene oxide-ethylene oxide ($EOx_1POyEOx_2$) triblock copolymer, which preferably has an average ethylene oxide chain length of between about 2 and about 90, preferably about 3 and about 50, more preferably between about 4 and about 20 ethylene oxide units, and an average propylene oxide chain length of between 20 and 70, preferably between 30 and 60, more preferably between 45 and 55 propylene oxide units. More preferably, the ethylene oxide-propylene oxide-ethylene oxide ($EOx_1POyEOx_2$) triblock copolymer has a molecular weight of from about 2000 to about 30,000 Daltons, preferably from about 3000 to about 20,000 Daltons, more preferably from about 4000 to about 15,000 Daltons.

Preferably, the copolymer comprises between 10% and 90%, preferably between 15% and 50%, most preferably between 15% and 25% by weight of the copolymer of the combined ethylene-oxide blocks. Most preferably the total ethylene oxide content is equally split over the two ethylene oxide blocks. Equally split herein means each ethylene oxide block comprising on average between 40% and 60% preferably between 45% and 55%, even more preferably between 48% and 52%, most preferably 50% of the total number of ethylene oxide units, the % of both ethylene oxide blocks adding up to 100%. Some ethylene oxide-propylene oxide-ethylene oxide ($EOx_1POyEOx_2$) triblock copolymer improve cleaning.

Suitable ethylene oxide—propylene oxide—ethylene oxide triblock copolymers are commercially available under the Pluronic series from the BASF company, or under the Tergitol L series from the Dow Chemical Company. A particularly suitable material is Pluronic® PE 9200. Other suitable materials include Pluronic® F38, F68 and F108.

Water-Soluble or Water-Dispersible Filler Particles

In addition to the above-described perfume ingredients and PEG, the perfume-containing particles of the present invention further comprise a water-soluble or water-dispersible filler material in a particulate form.

The filler material can be or comprise a water-soluble material selected from the group consisting of water soluble inorganic alkali metal salt, water-soluble alkaline earth metal salt, water-soluble organic alkali metal salt, water-soluble organic alkaline earth metal salt, water soluble carbohydrate, water-soluble silicate, water soluble urea, and any combination thereof.

Alkali metal salts can be, for example, selected from the group consisting of salts of lithium, salts of sodium, and salts of potassium, and any combination thereof. Useful alkali metal salts can be, for example, selected from the group consisting of alkali metal fluorides, alkali metal chlorides, alkali metal bromides, alkali metal iodides, alkali metal sulfates, alkali metal bisulfates, alkali metal phosphates, alkali metal monohydrogen phosphates, alkali metal dihydrogen phosphates, alkali metal carbonates, alkali metal monohydrogen carbonates, alkali metal acetates, alkali metal citrates, alkali metal lactates, alkali metal pyruvates, alkali metal silicates, alkali metal ascorbates, and combinations thereof. Preferred alkali metal salts can be selected from the group consisting of, sodium fluoride, sodium chloride, sodium bromide, sodium iodide, sodium sulfate, sodium bisulfate, sodium phosphate, sodium monohydrogen phosphate, sodium dihydrogen phosphate, sodium carbonate, sodium hydrogen carbonate, sodium acetate, sodium citrate, sodium lactate, sodium tartrate, sodium silicate, sodium ascorbate, potassium fluoride, potassium chloride, potassium bromide, potassium iodide, potassium sulfate, potassium bisulfate, potassium phosphate, potassium monohydrogen phosphate, potassium dihydrogen phosphate, potassium carbonate, potassium monohydrogen carbonate, potassium acetate, potassium citrate, potassium lactate, potassium tartrate, potassium silicate, potassium, ascorbate, and combinations thereof.

Alkaline earth metal salts can be selected from the group consisting of alkaline earth metal fluorides, alkaline earth metal chlorides, alkaline earth metal bromides, alkaline earth metal iodides, alkaline earth metal sulfates, alkaline earth metal bisulfates, alkaline earth metal phosphates, alkaline earth metal monohydrogen phosphates, alkaline earth metal dihydrogen phosphates, alkaline earth metal carbonates, alkaline earth metal monohydrogen carbonates, alkaline earth metal acetates, alkaline earth metal citrates, alkaline earth metal lactates, alkaline earth metal pyruvates, alkaline earth metal silicates, alkaline earth metal ascorbates, and combinations thereof. Preferred alkaline earth metal salts can be selected from the group consisting of salts of magnesium, salts of calcium, and the like, and combinations thereof, including, for example, magnesium fluoride, magnesium chloride, magnesium bromide, magnesium iodide, magnesium sulfate, magnesium phosphate, magnesium monohydrogen phosphate, magnesium dihydrogen phosphate, magnesium carbonate, magnesium monohydrogen carbonate, magnesium acetate, magnesium citrate, magnesium lactate, magnesium tartrate, magnesium silicate, magnesium ascorbate, calcium fluoride, calcium chloride, calcium bromide, calcium iodide, calcium sulfate, calcium phosphate, calcium monohydrogen phosphate, calcium dihydrogen phosphate, calcium carbonate, calcium monohydrogen carbonate, calcium acetate, calcium citrate, calcium lactate, calcium tartrate, calcium silicate, calcium ascorbate, and combinations thereof.

The filler material can also be water-dispersible material selected from the group consisting of starch (including modified starch), cellulose (including modified cellulose) zeolite, silica, clay, and combinations thereof.

Particularly preferred filler materials for the practice of the present invention include, but are not limited to: sodium chloride, sodium sulfate, sodium carbonate, sodium bicarbonate, potassium chloride, potassium sulfate, potassium carbonate, potassium bicarbonate, magnesium chloride, magnesium sulfate, calcium bicarbonate, zeolite, silica, clay, and combinations thereof. Most preferred filler materials are sodium chloride, sodium sulfate, sodium carbonate, or combinations thereof.

The water-soluble or water-dispersible filler material is present in the perfume-containing particles in a particulate form, i.e., as discrete particles having a specific particle size distribution. Such specific particle size distribution is particularly effective for reducing compositional variations of the perfume-containing particles from batch to batch. Without being bound by any theory, it is believed that because the water-soluble or water-dispersible filler particles may not dissolve in the molten polymer blend during the perfume particle making process, such filler particles may sediment to the bottom of the mixing tank, thereby causing compositional variations in the perfume particles so formed. One way to mitigate this problem is to provide constant and increased agitation in the mixing tank to reduce the sedimentation, but this approach results in significant increase in capital investment, operational cost and processing complexity. Inventors of the present invention discovered that by using filler particles with predominant particle sizes no more than 150 microns, compositional variations in the perfume particles so form can be significantly reduced (in comparison with using filler particles with predominant particle sizes greater than 150 microns), without the need for constant and increased agitation in the mixing tank. Therefore, the sedimentation problem can be effectively resolved or mitigated by the present invention little or no increase in capital investment, operational cost, and/or processing complexity.

Specifically, from about 80 wt % to 100 wt %, preferably from about 85 wt % to 100 wt %, more preferably from about 90 wt % to 100 wt %, still more preferably from about 95 wt % to 100 wt %, still more preferably from about 98 wt % to 100 wt %, and most preferably from about 99 wt % to 100 wt % of such discrete particles have a particle size of no more than 150 microns. Preferably, from about 80 wt % to 100 wt % of such discrete particles have a particle size of from about 5 microns to about 150 microns, preferably from about 10 microns to about 125 microns, more preferably from about 10 microns to about 105 microns, most preferably from about 10 microns to about 90 microns. Particle sizes of the water-soluble or water-dispersible filler particles in the perfume-containing particles can be readily determined by the Micro-CT test described hereinafter in Test Method 1.

Preferably, each of the perfume-containing particles comprises from about 5 wt % to about 90 wt %, preferably from about 10 wt % to about 70 wt %, more preferably from about 20 wt % to about 60 wt % of water-soluble or water-dispersible filler particles.

Optional/Adjunct Ingredients

The perfume-containing particles of the present invention may optionally comprise one or more optional/adjunct ingredients, including colorants, solvents, softening actives, and combinations thereof, in an amount ranging from about 0.01 wt % to about 10 wt %, preferably from about 0.02 wt % to about 8 wt %, more preferably from about 0.1 wt % to about 5 wt %. The colorants may impart to the perfume-containing particles a color selected from the group consisting of blue, green, yellow, orange, pink, red, purple, grey, and the like. The colorants may be selected from the group consisting of dyes, pigments, and combinations thereof. Preferably, the colorants include at least one dye selected from those typically used in laundry detergent or fabric softeners. Examples of suitable dyes include, but are not limited to, LIQUITINT BLUE BL, LIQUITINT PINK AM, AQUA AS CYAN 15, and VIOLET FL, available from Milliken Chemical. If a dye is employed, the perfume-containing particles may comprise less than about 0.1%, alternatively about 0.001% to about 0.1%, alternatively about 0.01% to about 0.02%, alternatively combinations thereof of such dye by weight of the particles.

The perfume-containing particles of the present invention may be substantially free of laundry active and/or fabric softener actives. To reduce costs and avoid formulation capability issues, one aspect of the invention may include perfume-containing particles that are essentially free or completely free of laundry actives and/or fabric softener actives. In one embodiment, each of the perfume-containing particles comprises less than about 3%, alternatively less than about 2%, alternatively less than about 1%, alternatively less than about 0.1% by weight of the perfume-containing particles, of laundry actives and/or fabric softener actives (or combinations thereof). Laundry actives may include: detergent surfactants, detergent builders, bleaching agents, enzymes, mixtures thereof, and the like. It is particularly preferred that the perfume particles of the present invention are substantially free of or essentially free of surfactants, because the presence of such surfactants may speed up dissolution of the perfume particles in water, which is undesirable in the context of the present invention. It is appreciated that a non-detersive level of surfactant may be used to help solubilize perfume contained in the composition. More preferably, the perfume particles of the present invention are substantially free of or essentially free of any detersive actives.

Depending on the application, the perfume-containing particles of the present invention may comprise a solvent selected from the group consisting of glycerin, polypropylene glycol, isopropyl myristate, dipropylene glycol, 1,2-propanediol, and PEG having a weight average molecular weight less than 2,000, and mixtures thereof.

The perfume-containing particles can further comprise an antioxidant. The antioxidant can help to promote stability of the color and or odor of the particles over time between production and use. The perfume-containing particles can comprise between about 0.001% to about 2%, preferably between 0.01% to about 1%, more preferably between about 0.05% to about 0.5% by weight of such antioxidant. The antioxidant can be butylated hydroxytoluene.

Method of Making Perfume-Containing Particles

The perfume-containing particles of the present invention may be formed by those methods known in the art for making pastilles. The perfume-containing particles of the present invention may be prepared in either a batch mode or a continuous mode. In a batch mode, molten PEG is loaded into a mixing vessel having temperature control. Perfume ingredients (e.g., free perfumes and/or PMCs), the water-soluble or water-dispersible filler particles (e.g., sodium chloride particles, sodium sulfate particles, sodium carbonate particles, and the like), and the optional ingredients (such as dyes, pigments, solvents, and the like) are then added and mixed with the molten PEG until homogeneous. In a continuous mode, molten PEG is mixed with the above-described perfume ingredients, filler particles, and optional ingredients in an in-line mixer such as a static mixer or a high shear mixer and the resulting homogeneous mixture is then used for pastillation. Perfume ingredients, filler particles and optional ingredients can be added to the molten PEG in any order or simultaneously at a step prior to pastillation.

The perfume-containing particles may be manufactured by a pastillation process. A desired formulation containing the above-described molten PEG, perfume ingredients, filler particles, and optional ingredients is provided as a viscous slurry. The viscous slurry can be provided at a processing temperature less than about 20 degrees Celsius above the onset of solidification temperature of the PEG material as determined by differential scanning calorimetry. In one embodiment, the PMCs can be added as a slurry to the molten PEG and free perfume to form the viscous slurry. The PMCs can also be added as a powder to the molten PEG and free perfume to form the viscous slurry.

In a specifically preferred embodiment of the present invention, gas or gas-generating ingredients can be added into the viscous slurry to form an aerated viscous slurry.

The viscous slurry, either aerated or unaerated, can then be formed into perfume-containing particles (especially in form of pastilles) by a ROTOFORMER available from Sandvik Materials Technology. Specifically, the viscous slurry can be distributed through a feed pipe to a stator. A cylinder is provided for rotating about the stator along a longitudinal axis L of such cylinder, wherein the cylinder has a periphery with a plurality of apertures disposed about the periphery. The viscous slurry is then passed through the apertures of the cylinder onto a moving conveyor beneath the cylinder to form droplets of such viscous slurry. Such droplets of the viscous slurry cool down to below the glass transition temperature of the PEG material on the moving conveyor, thereby forming a plurality of pastilles having a hemispherical or compressed hemispherical shape (depending on the viscosity of the slurry). The process can be implemented using any of the apparatuses disclosed herein.

In order to control the particle size distribution of water-soluble or water-dispersible filler particles added into the molten PEG to reduce compositional variations in the perfume particles so form, the present invention can either select filler particles already having the desired particle size distribution as mentioned hereinabove, or treat filler particles (e.g., through grinding and sieving) to effectuate the desired particle size distribution.

For example, larger water-soluble or water-dispersible filler particles can be ground and/or sieved to provide filler particles of smaller particle sizes. The following sieves can be readily used for such purpose:

- Sieve #standard Tyler mesh 100 (having a mesh size of 150 microns)
- Sieve #standard Tyler mesh 115 (having a mesh size of 125 microns)
- Sieve #standard Tyler mesh 150 (having a mesh size of 106 microns)
- Sieve #standard Tyler mesh 170 (having a mesh size of 90 microns)
- Sieve #standard Tyler mesh 200 (having a mesh size of 75 microns)

Further, smaller water-soluble or water-dispersible filler particles can be sieved out, to provide the desired particle size distribution. The following sieves can be readily used for such purpose:

- Sieve #standard Tyler mesh 325 (having a mesh size of 45 microns)
- Sieve #standard Tyler mesh 400 (having a mesh size of 38 microns)
- Sieve #standard Tyler mesh 625 (having a mesh size of 20 microns)
- Sieve #standard Tyler mesh 800 (having a mesh size of 15 microns)
- Sieve #standard Tyler mesh 1250 (having a mesh size of 10 microns)
- Sieve #standard Tyler mesh 2500 (having a mesh size of 5 microns)

For example, a raw material containing water-soluble or water-dispersible filler particles can be sieved, either with or without being ground first, by a sieve, i.e., Sieve #standard Tyler mesh 100 having a mesh size of 150 microns. Corresponding, the filler particles passing through this first sieve will all have a particle size of no more than about 150 microns. Alternatively, the filler particle raw material can be sieved by Sieve #standard Tyler mesh 115 having a mesh size of 125 microns, so that the filler particles passing through this sieve will all have a particle size of no more than about 125 microns. Alternatively, the filler particle raw material can be sieved by Sieve #standard Tyler mesh 150 having a mesh size of 106 microns, so that the filler particles passing through this sieve will all have a particle size of no more than about 106 microns.

Further, the filler particle raw material can further be sieved by Sieve #standard Tyler mesh 2500 having a mesh size of 5 microns. Because all particles passing through this sieve will have a particle size of no more than about 5 microns, the passing particles can be removed, and the non-passing particles can be retained, to ensure that the filler particles used have a predominant particle size of at least 5 microns. Similarly, the filler particle raw material can further be sieved by Sieve #standard Tyler mesh 1250 having a mesh size of 10 microns, and the passing particles can be removed to ensure that the retained particles (i.e., non-passing particles) have a predominant particle size of at least 10 microns.

Packaged Composition

A unit dose of the perfume-containing particles so formed or a plurality of such unit doses may be contained in a package, to form a packaged composition. The package may be a bottle, bag, or other container. In one embodiment, the package is a bottle, preferably a PET bottle comprising a translucent portion to showcase the perfume-containing particles to a viewing consumer. In one embodiment, the package comprises a single unit dose (e.g., trial size sachet), or multiple unit doses (e.g., from about 15 unit doses to about 30 unit doses).

Dosing

A plurality of perfume-containing particles may collectively comprise a unit dose for dosing to a laundry washing machine or laundry was basin. A single unit dose of the pastilles may comprise from about 13 g to about 27 g, alternatively from about 14 g to about 20 g, alternatively from about 15 g to about 19 g, alternatively from about 16 g to about 18 g, alternatively combinations thereof.

The aforementioned package may comprise a dosing means for dispensing the perfume-containing particles from a package to a laundry washing machine (or laundry wash basin in hand washing applications). The user may use the dosing means to meter the recommended unit dose amount or simply use the dosing means to meter the perfume-containing particles according to the user's own scent preference. Examples of a dosing means may be a dispensing cap, dome, or the like, that is functionally attached to the package. The dosing means can be releasably detachable from the package and re-attachable to the package, such as for example, a cup mountable on the package. The dosing means may be tethered (e.g., by hinge or string) to the rest of the package (or alternatively un-tethered). The dosing means may have one or more demarcations (e.g., fill-line) to indicate a recommend unit dose amount. The packaging may include instructions instructing the user to open the removable opening of the package, and dispense (e.g., pour) the perfume-containing particles contained in the package into the dosing means. Thereafter, the user may be instructed to dose the perfume-containing particles in the dosing means to a laundry washing machine or laundry wash basin. The perfume-containing particles of the present invention may be used to add freshness to laundry. The package including the dosing means may be made of plastic.

In one embodiment, the perfume-containing particles of the present invention can be administered to a laundry machine as used during the "wash cycle" of the washing machine (but a "rinse cycle" may also be used). In another embodiment, the perfume-containing particles of the present invention are administered in a laundry wash basin—during washing and/or rinsing laundry. In a laundry hand rinsing application, the perfume-containing particles may further comprise an "antifoam agent" such as those available from Wacker.

TEST METHODS

Test Method 1: Micro-CT Test for Measuring Particle Sizes of Water-Soluble or Water-Dispersible Filler Particles in Perfume-Containing Particles X-ray Micro-CT is used to acquire and analyze images of water-soluble or water-dispersible filler particles in a sample for particle size determination according to the present invention.

A 10 mm punch (in diameter) is used to physically extract a representative region of a sample. The punched sample (around 10 mm in diameter) is then mounted on a sample holder. The sample holder is then placed in an X-ray scanner such as GE Phoenix vl tomel x m. (GE Sensing & Inspection Technologies GmbH Niels-Bohr-Str.7 31515 Wunstorf, Germany). The scanning parameters used include: micro-tube; voltage: 180 kV; current: 120 μA; tube mode: 1; timing: 1000 ms; averaging: 2; skip frames: 1; number of images: 1500. The resulting data set is 2014×2014×2014 voxels with attenuation values represented as 16 bit integers. Each voxel has a diameter of 7 microns.

To measure particle size distribution in the sample, the following steps can be performed:

1. An automated thresholding algorithm (Otsu's method, which is a well-known thresholding method implemented in Matlab; see "A Threshold Selection Method from Gray-Level Histograms", Nobuyuki Otsu, 2EEE Transactions On Systems Man, and Cybernetics, VOL. SMC-9, NO. 1, January 1979) is applied to each of the datasets resulting in a labelled image representing the particles (gray level 2), matrix (gray level 1), and void (gray level 0).
2. The labelled image datasets are imported into Fiji (v1.51u), followed by a further thresholding step where the particles are set to gray level 255 and the rest set to gray level 0.
3. Next, a Fiji embedded plugin called "3D watershed split" is used to separate the particles next to each other and give each particle a unique ID in three dimensional space (see J. Ollion, J. Cochennec, F. Loll, C. Escudé, T. Boudier. (2013) TANGO: "A Generic Tool for High-throughput 3D Image Analysis for Studying Nuclear Organization", Bioinformatics 2013 Jul. 15; 29(14): 1840-1).
4. The calculated "3D watershed split" datasets are imported into "3D manager", a plugin in Fiji to measure the minimum center to surface distance (DCmin). The center to surface distance (DCmin) less than 1 voxel was filtered out as noise. The minimum diameter (Dmin) is calculated by Dmin=DCmin*2 and is recorded as the size of the respective particles.

EXAMPLES

Example 1: Comparative Test Showing Impact of NaCl Filler Particle Sizes on Batch-to-Batch Compositional Variations of Perfume-Containing Beads First, a PEG4000 raw material (from Jiangsu Hai an PetroChemical Plant) is heated in an oven at 75° C. overnight to form a molten PEG slurry. Particles of NaCl (from Guangzhou Shengxin Chemical Technology) are ground using a grinder (Fritsch Pulverisette 14) at a filling speed of 45%, a RPM of about 6000 rpm, and a mesh size of about 0.5 mm Next, the ground NaCl particles are sieved by the following 3 sieves:

Sieve #standard Tyler mesh 325 (having a mesh size of 45 microns)

Sieve #standard Tyler mesh 150 (having a mesh size of 106 microns)

Sieve #standard Tyler mesh 100 (having a mesh size of 150 microns)

As a result, the ground NaCl particles are separated into three (3) portions, as follows:

Portion 1: having particle sizes of more than 150 microns (likely between 150-250 microns);

Portion 2: having particle sizes between 106-150 microns; and

Portion 3: having particle sizes between 45-106 microns.

Suitable amounts of the molten PEG slurry, respective portion of sieved NaCl particles, perfume microcapsules, and free perfumes are measured and mixed to form respective perfume-containing compositions, with specific compositional breakdowns as indicated by the table below:

TABLE 1

| | Compositions | | |
|---|---|---|---|
| Wt (%) | 1 | 2 | 3 |
| PEG4000 | 64 | 64 | 64 |
| NaCl Particles 1 (150+ microns) | 30 | — | — |
| NaCl Particles 2 (106-150 microns) | — | 30 | — |
| NaCl Particles 3 (45-106 microns) | — | — | 30 |
| Perfume microcapsules | 3 | 3 | 3 |
| Free perfumes | 3 | 3 | 3 |
| Total: | 100 | 100 | 100 |

Each respective sieved portion of the NaCl particles is placed in a clean beaker with an agitator and warmed in an oven at 75° C. for about 1 hour, followed by addition of suitable amounts of the molten PEG slurry, perfume microcapsules, and free perfumes, as described hereinabove. Weighing is conducted within 2 minutes to avoid solidification of the raw materials.

The mixture is hand-mixed for about 2 minutes to form a viscous and homogenous slurry (this can also be done with a motor-driven agitator), while the beaker is placed on a heater to maintain the mixture at a temperature of about 75° C.

The viscous slurry is then poured into molds containing bead-shape cavities at about 30 seconds after the mixing step is completed, as follows:

First pour ⅓ of the viscous slurry from the warmed beaker into a first mold (this first batch represents the top layer of the slurry);

Then pour another ⅓ of the viscous slurry from the warmed beaker into second mold (this second batch represents the middle layer of the slurry); and Last pour the final ⅓ of the viscous slurry from the warmed beaker into a third mold (this third batch represents the bottom layer of the slurry).

The interval between each pouring should not be longer than 5 s. The viscous slurry cools down to ambient temperature in respective molds, thereby forming solidified bead-shaped perfume-containing particles.

Each batch of perfume-containing particles so formed is then weighed to obtain a sample of 1.5 g (+/−0.0002 g), which is then dissolved into a 1000 ml flask filled with deionized water. The solution is stirring for about 60 minutes to ensure complete dissolution of the sample perfume-containing particles.

A pipet is used to draw about 10 ml of the solution, which is diluted to 100 ml with deionized water. A syringe with a 0.45 μm Nylon syringe filter is then used to draw about 1 ml of the diluted solution, which is placed into a glass vial for measuring the respective concentration of NaCl therein through ion chromatography analysis by a DIONEX ICS3000 DP/DC/AS with a conductivity detector (1M sodium hydroxide solution is used as an eluent).

Three (3) samples are taken from each batch of perfume-containing particles for measurement of the NaCl concentration therein. Following are the resulting NaCl concentrations measured from perfume-containing particles made by different batches (i.e., top/medium/bottom layers) of different viscous slurries containing NaCl filler particles of different sizes (i.e., 45-106/106-150/150+ microns):

TABLE 2

| NaCl Concentrations (ppm) | Sample 1 | Sample 2 | Sample 3 | Overall Mean | Overall RSD % across batches |
|---|---|---|---|---|---|
| Composition 1 (NaCl particles >150 um)/Batch 1 (Top layer) | 27.68 | 28.31 | 28.12 | 30.06 | 6.2 |
| Composition 1 (NaCl particles >150 um)/Batch 2 (Middle layer) | 30.47 | 31.38 | 29.34 | | |
| Composition 1 (NaCl particles >150 um)/Batch 3 (Bottom layer) | 31.35 | 32.88 | 30.98 | | |
| Composition 2 (NaCl particles 106-150 um)/Batch 1 (Top layer) | 31.66 | 30.76 | 31.60 | 30.86 | 1.9 |
| Composition 2 (NaCl particles 106-150 um)/Batch 2 (Middle layer) | 30.33 | 29.89 | 30.39 | | |
| Composition 2 (NaCl particles 106-150 um)/Batch 3 (Bottom layer) | 31.28 | 30.73 | 31.08 | | |
| Composition 3 (NaCl particles 45-106 um)/Batch 1 (Top layer) | 29.99 | 30.33 | 31.81 | 30.43 | 1.0 |
| Composition 3 (NaCl particles 45-106 um)/Batch 2 (Middle layer) | 30.02 | 30.24 | 30.10 | | |
| Composition 3 (NaCl particles 45-106 um)/Batch 3 (Bottom layer) | 30.57 | 31.27 | 29.54 | | |

It can be seen from data above that overall compositional variations (as indicated by overall RSD % of the NaCl concentration across batches) are significantly reduced when the NaCl particle sizes are no greater than 150 microns.

Example 2: Comparative Test Showing Impact of $Na_2SO_4$ Filler Particle Sizes on Batch-to-Batch Compositional Variations of Perfume-Containing Beads First, a PEG4000 raw material (from Jiangsu Hai' an PetroChemical Plant) is heated in an oven at 75° C. overnight to form a molten PEG slurry. Particles of $Na_2SO_4$ (from Hongya Qingyijiang Chemical Industry) are ground using a grinder (Fritsch Pulverisette 14) at a filling speed of 45%, a RPM of about 6000 rpm, and a mesh size of about 0.5 mm Next, the ground $Na_2SO_4$ particles are sieved by the following 3 sieves:

- Sieve #standard Tyler mesh 325 (having a mesh size of 45 microns)
- Sieve #standard Tyler mesh 150 (having a mesh size of 106 microns)
- Sieve #standard Tyler mesh 100 (having a mesh size of 150 microns)

As a result, the ground $Na_2SO_4$ particles are separated into three (3) portions, as follows:

- Portion 1: having particle sizes of more than 150 microns (likely between 150-250 microns);
- Portion 2: having particle sizes between 106-150 microns; and
- Portion 3: having particle sizes between 45-106 microns.

Suitable amounts of the molten PEG slurry, respective portion of sieved $Na_2SO_4$ particles, perfume microcapsules, and free perfumes are measured and mixed to form respective perfume-containing compositions, with specific compositional breakdowns as indicated by the table below:

TABLE 3

| | Compositions | | |
|---|---|---|---|
| Wt (%) | 4 | 5 | 6 |
| PEG4000 | 64 | 64 | 64 |
| $Na_2SO_4$ Particles 1 (150+ microns) | 30 | — | — |
| $Na_2SO_4$ Particles 2 (106-150 microns) | — | 30 | — |
| $Na_2SO_4$ Particles 3 (45-106 microns) | — | — | 30 |
| Perfume microcapsules | 3 | 3 | 3 |
| Free perfumes | 3 | 3 | 3 |
| Total: | 100 | 100 | 100 |

Each respective sieved portion of the $Na_2SO_4$ filler particles is placed in a clean beaker with an agitator and warmed in an oven at 75° C. for about 1 hour, followed by addition of suitable amounts of the molten PEG slurry, perfume microcapsules, and free perfumes, as described hereinabove. Weighing is conducted within 2 minutes to avoid solidification of the raw materials.

The mixture is hand-mixed for about 2 minutes to form a viscous and homogenous slurry (this can also be done with a motor-driven agitator), while the beaker is placed on a heater to maintain the mixture at a temperature of about 75° C.

The viscous slurry is then poured into molds containing bead-shape cavities at about 30 seconds after the mixing step is completed, as follows:

- First pour ⅓ of the viscous slurry from the warmed beaker into a first mold (this first batch represents the top layer of the slurry);
- Then pour another ⅓ of the viscous slurry from the warmed beaker into second mold (this second batch represents the middle layer of the slurry); and
- Last pour the final ⅓ of the viscous slurry from the warmed beaker into a third mold (this third batch represents the bottom layer of the slurry).

The interval between each pouring should not be longer than 5 s. The viscous slurry cools down to ambient temperature in respective molds, thereby forming solidified bead-shaped perfume-containing particles.

Each batch of perfume-containing particles so formed is then weighed to obtain a sample of 1.5 g (+/−0.0002 g), which is then dissolved into a 1000 ml flask filled with deionized water. The solution is stirring for about 60 minutes to ensure complete dissolution of the sample perfume-containing particles.

A pipet is used to draw about 10 ml of the solution, which is diluted to 100 ml with deionized water. A syringe with a 0.45 μm Nylon syringe filter is then used to draw about 1 ml of the diluted solution, which is placed into a glass vial for measuring the respective concentration of $Na_2SO_4$ therein through ion chromatography analysis by a DIONEX ICS3000 DP/DC/AS with a conductivity detector (1M sodium hydroxide solution is used as an eluent).

Three (3) samples are taken from each batch of perfume-containing particles for measurement of the $Na_2SO_4$ concentration therein. Following are the resulting $Na_2SO_4$ concentrations measured from perfume-containing particles made by different batches (i.e., top/medium/bottom layers) of different viscous slurries containing $Na_2SO_4$ filler particles of different sizes (i.e., 45-106/106-150/150+ microns):

TABLE 4

| $Na_2SO_4$ Concentrations (ppm) | Sample 1 | Sample 2 | Sample 3 | Overall Mean | Overall RSD % across batches |
|---|---|---|---|---|---|
| Composition 4 ($Na_2SO_4$ particles >150 um)/Batch 1 (Top layer) | 27.89 | 26.72 | 28.55 | 30.70 | 8.9 |
| Composition 4 ($Na_2SO_4$ particles >150 um)/Batch 2 (Middle layer) | 31.01 | 30.42 | 32.42 | | |
| Composition 4 ($Na_2SO_4$ particles >150 um)/Batch 3 (Bottom layer) | 32.73 | 36.34 | 30.19 | | |
| Composition 5 ($Na_2SO_4$ particles 106-150 um)/Batch 1 (Top layer) | 28.95 | 29.53 | 28.18 | 29.49 | 2.8 |
| Composition 5 ($Na_2SO_4$ particles 106-150 um)/Batch 2 (Middle layer) | 29.34 | 29.48 | 28.59 | | |
| Composition 5 ($Na_2SO_4$ particles 106-150 um)/Batch 3 (Bottom layer) | 27.31 | 31.52 | 32.50 | | |
| Composition 6 ($Na_2SO_4$ particles 45-106 um)/Batch 1 (Top layer) | 29.85 | 29.90 | 28.39 | 30.30 | 2.8 |
| Composition 6 ($Na_2SO_4$ particles 45-106 um)/Batch 2 (Middle layer) | 29.09 | 30.93 | 31.31 | | |
| Composition 6 ($Na_2SO_4$ particles 45-106 um)/Batch 3 (Bottom layer) | 30.45 | 32.27 | 30.48 | | |

It can be seen from data above that overall compositional variations (as indicated by overall RSD % of the $Na_2SO_4$ concentration across batches) are significantly reduced when the $Na_2SO_4$ particle sizes are no greater than 150 microns.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A packaged composition comprising a plurality of perfume-containing particles, wherein each of said perfume-containing particles comprises:

a perfume ingredient;

polyethylene glycol; and water-soluble or water-dispersible filler particles, wherein from 80 wt % to 100 wt % of said water-soluble filler particles are characterized by a particle size ranging from 5 microns to 150 microns, wherein said water-soluble or water-dispersible filler particles comprise a filler material selected from the group consisting of sodium chloride, sodium sulfate, and combinations thereof;

wherein each of said perfume-containing particles has a mass of from 0.1 mg to 5 g and a maximum dimension of from 3 mm to 10 mm.

2. The packaged composition of claim 1, wherein from 80 wt % to 100 wt % of said water-soluble or water-dispersible filler particles are characterized by a particle size ranging from 10 microns to 125 microns.

3. The packaged composition of claim 2, wherein the particle size ranges from 10 microns to 105 microns.

4. The packaged composition of claim 3, wherein the particle size ranges from 10 microns to 90 microns.

5. The packaged composition according to claim 1, wherein said water-soluble or water-dispersible filler particles are present in each perfume-containing particle in an amount ranging from 5% to 90%, by total weight of each perfume-containing particle.

6. The packaged composition according to claim 5, wherein the water-soluble or water-dispersible filler particles are present in each perfume-containing particle in an amount ranging from from 10% to 70%, by total weight of each perfume-containing particle.

7. The packaged composition according to claim 5, wherein the water-soluble or water-dispersible filler particles are present in each perfume-containing particle in an amount ranging from 20% to 60%, by total weight of each perfume-containing particle.

8. The packaged composition according to claim 1, wherein each of said perfume-containing particles comprises one or more free perfumes.

9. The packaged composition according to claim 8, wherein the one or more free perfumes are present in an amount ranging from 0.1% to 20%, by total weight of each perfume-containing particle.

10. The packaged composition according to claim 1, wherein each of said perfume-containing particles comprises an encapsulated perfume.

11. The packaged composition according to claim 1, wherein the polyethylene glycol has a weight average molecular weight (Mw) from 2,000 to 30,000 Daltons, wherein the polyethylene glycol is present in each perfume-containing particle in an amount ranging from 5% to 90%, by total weight of each perfume-containing particle.

12. The packaged composition according to claim 1, wherein each of the perfume-containing particles comprises one or more other ingredients selected from the group consisting of colorants, solvents, softening actives, and combinations thereof, and wherein said one or more ingredients are present in an amount ranging from 0.01% to 10%, by total weight of each perfume-containing particle.

13. The packaged composition according to claim 1, wherein each of said perfume-containing particles has a hemispherical shape or a compressed hemispherical shape.

14. A method of making perfume-containing particles, comprising the steps of:

a. forming a viscous slurry by mixing a perfume ingredient, molten polyethylene glycol, water-soluble or water-dispersible filler particles and optionally one or more other ingredients, wherein said water-soluble or water-dispersible filler particles can pass through a sieve characterized by a mesh size of 150 um; and b. forming perfume-containing particles from the viscous slurry, wherein each of the perfume-containing particles so formed has a mass of from 0.1 mg to 5 g and a maximum dimension of from 3 mm to 10 mm;

wherein said water-soluble or water-dispersible filler particles comprise a filler material selected from the group consisting of sodium chloride, sodium sulfate, and combinations thereof.

15. The method of claim 14, wherein said water-soluble or water-dispersible filler particles can pass through a second sieve characterized by a mesh size of 125 μm.

16. The method of claim 14, wherein said water-soluble or water-dispersible filler particles cannot pass through a fourth sieve characterized by a mesh size of 5 μm.

17. The method according to claim 14, wherein the one or more other ingredients are selected from the group consisting of colorants, solvents, softening actives, and combinations thereof.

* * * * *